United States Patent [19]

Lovik

[11] Patent Number: 4,809,483

[45] Date of Patent: Mar. 7, 1989

[54] LOW COST BALLOON STUFFING SYSTEM

[76] Inventor: Craig J. Lovik, 8565 Custer School Rd., Custer, Wash. 98240

[21] Appl. No.: 189,975

[22] Filed: May 4, 1988

Related U.S. Application Data

[63] Continuation-in-part of Ser. No. 156,165, Feb. 12, 1988.

[51] Int. Cl.[4] ..... B65B 43/36; B65B 39/04; B65B 39/06; B65B 31/00

[52] U.S. Cl. ..... 53/434; 53/459; 53/258; 53/385; 53/390; 137/223; 137/268; 446/220

[58] Field of Search ..... 53/457, 459, 570, 385, 53/390, 258, 260, 262, 434, 433, 473; 137/268, 223, 1, 584; 446/220, 222, 223, 226

[56] References Cited

U.S. PATENT DOCUMENTS

| | | | |
|---|---|---|---|
| 1,203,967 | 11/1916 | Bowers | 137/223 X |
| 1,218,314 | 3/1917 | Read | 53/262 X |
| 1,229,794 | 6/1917 | Salzer . | |
| 1,321,833 | 11/1919 | Lyon | 137/223 |
| 1,374,975 | 4/1921 | Zeidler | 53/390 X |
| 1,471,886 | 10/1923 | Dessau . | |
| 2,592,347 | 4/1952 | Shute | 446/220 |
| 2,625,770 | 1/1953 | Steen et al. . | |
| 2,635,387 | 4/1953 | Anderson . | |
| 2,900,779 | 8/1959 | Baxter et al. | 53/390 X |
| 2,927,383 | 3/1960 | Longino . | |
| 2,962,803 | 12/1960 | Jones | 53/258 X |
| 3,298,156 | 1/1967 | Lerner | 53/385 X |
| 3,616,569 | 11/1971 | Litt et al. | 446/220 |
| 3,807,130 | 4/1974 | Pedersen | 53/258 |
| 3,827,210 | 8/1974 | Smalley et al. | 53/258 X |
| 3,935,691 | 2/1976 | Broch | 53/385 X |
| 4,028,775 | 6/1977 | Tysver | 53/258 X |
| 4,157,003 | 6/1979 | Kamphaus | 53/385 X |
| 4,203,269 | 5/1980 | Petersen | 53/258 X |
| 4,232,477 | 11/1980 | Lin . | |
| 4,335,538 | 6/1982 | Greenberg | 446/227 X |
| 4,597,244 | 7/1986 | Pharo | 53/434 |
| 4,639,232 | 1/1987 | Wang . | |
| 4,651,506 | 3/1987 | Lerner etal. | 53/385 X |
| 4,701,148 | 10/1987 | Cotey | 137/223 X |
| 4,704,934 | 11/1987 | Nosrati | 446/220 X |
| 4,737,133 | 4/1988 | Neumeier | 446/222 X |

*Primary Examiner*—Horace M. Culver
*Attorney, Agent, or Firm*—Hughes, Cassidy & Multer

[57] ABSTRACT

A balloon stuffing system (25, 25') including a tubular member (26) open at one end (28) thereof and defining a chamber (31) capable of receiving the object (34) to be stuffed into a balloon (35); a hollow, tubular, piston-like ejector rod (29) passing through the opposite end (30) of the tubular member (26); and, wherein provision is made for coupling the axial bore (58) extending through the hollow, tubular, piston-like ejector rod (29), and therefore the chamber (31) in the tubular member (26) and the balloon (35) secured thereto, to a source of inflation medium by either: (i) attaching a mouthpiece (84) to the projecting end of the ejector rod (29) so as to permit pressurization of the chamber (31) and the interior of the balloon (35) by blowing through the mouthpiece (84); or (ii), coupling the hollow, tubular, piston-like ejector rod (29) to a conventional hand-held, hand-operated air inflation pump (41, 41'); and, wherein the ejector rod (29) may be selectively: (a) unlatched from the pump housing (42) and latched to the tubular member (26) during ballon inflation; and (b) latched to the pump housing (42) and unlatched from the tubular member (26) during ejection of the object (34) temporarily stored in the tubular member (26) and insertion thereof into the balloon (35).

18 Claims, 8 Drawing Sheets

LOW COST BALLOON STUFFING SYSTEM

RELATED APPLICATION

This application is related to, and a continuation-in-part application based in part on, the co-pending U.S. patent application of Craig J. Lovik entitled "BALLOON STUFFING SYSTEM" filed Feb. 12, 1988 and assigned Ser. No. 07/156,165.

BACKGROUND OF THE INVENTION

1. Technical Field

The present invention relates generally to balloons; and, more particularly, to methods and apparatus for stuffing objects such, merely by way of example, as teddy bears and similar soft stuffed animals and/or toys, real and/or artificial flowers, and similar objects or favors into the interior of conventional balloons.

More specifically, the present invention relates to highly simplified, low cost apparatus, and methods of operating the same, suitable for inserting objects into the interior of conventional balloons wherein the apparatus includes: (i) a relatively large diameter—e.g., from about one inch (1") to about four inches (4"), or more, but typically on the order of from about two inches (2") to about three inches (3")—tubular member which is open at one end, imperforate throughout its length, and closed and sealed at its opposite end; (ii) a coupling for connecting the sealed tubular member to a source of air, helium or other inflation medium; (iii) provision for mounting the inflation aperture, or mouth, and constricted neck, of a conventional balloon uniformly over, about and around the open end of the sealed tubular member so as to create a single, enclosed, common, sealed chamber defined by the interior of the tubular member and the interior of the uninflated balloon; and (iv), a piston-like ejector rod axially movable through the tubular member and capable of being manually shifted for ejecting the stuffed toy or other favor from the tubular member and projecting it into the balloon; and, wherein the user need merely insert the stuffed toy or other object into the tubular member, attach the uninflated balloon to the open end of the tubular member, energize the source of inflation medium so as to pressurize the tubular member and balloon interiors and thereby inflate the balloon, shift the ejector rod axially through the tubular member to push the stuffed toy or other object out of the open end of the tubular member and into the now inflated balloon, and to thereafter twist the narrow constricted neck of the balloon adjacent the inflation aperture into a tight spiral and/or otherwise tie off the inflation aperture of the now inflated stuffed balloon as it is removed from the tubular member, whereupon the stuffed animal or favor is permanently retained within the inflated sealed balloon until such time as the balloon bursts.

2. Background Art

There are many occasions when people desire to utilize balloons in some form in connection with celebrations such, for example, as birthdays for both children and adults, anniversaries, various types of parties, grand openings, and a wide range of similar celebrations. Moreover, it is often desirable to utilize other tokens of affection in connection with such celebrations—e.g., flowers and/or small gifts for adult birthdays, anniversaries and the like; or stuffed animals and/or toys, favors and similar items for childrens' birthday parties.

Indeed, on some occasions in the past it has been known to stuff such favors or similar items into a balloon prior to inflation thereof so that the toy, flower or other favor is delivered to the recipient in an enclosed sealed balloon and can later be removed from the balloon—for example, by or upon bursting of the balloon—and used for its intended purpose. However, while the stuffing of flowers and other favors into uninflated balloons is known, and has been achieved, the technique employed is plagued with a number of difficulties; and, as a result, it has been a technique only rarely employed. Thus, when stuffing conventional balloons, the technique requires manual insertion of the favor through the relatively narrow, constricted, inflation aperture and constricted neck of the balloon prior to inflation thereof. An exemplary patent illustrating this technique in U.S. Pat. No. 1,471,886—Dessau, a patent which issued almost sixty-five (65) years ago. Thus, Dessau suggests the favor or other device be formed of crepe rubber " . . . which can be easily fashioned into varying shapes and can be temporarily rolled up into a compact form . . . " so that it can " . . . be passed through the inflation aperture . . . " of the balloon (Dessau Specification, Lines 27–31).

Other prior art patents of interest include U.S. Pat. Nos. 2,635,387—Anderson [a toy balloon novelty item employing a special valve configuration enabling inflation of a second balloon inside a first balloon]; 2,625,770—Steen, et al [a self-sealing toy balloon again providing for inflation of a second balloon within a first balloon]; and 2,927,383—Longino [a balloon world satellite employing a pair of spaced, inflated, concentric, spherical body members and a satellite captive within the space therebetween].

Other patents of interest contemplate the employment of specially designed inflatable devices which are not conventional balloons and which are exemplified by U.S. Pat. Nos. 4,232,477—Lin [an inflatable hassock-shaped toy]; 4,335,538—Greenberg [an inflatable overhead crib gym toy]; and, 4,639,232—Wang [a toy having an envelope enclosing a movable mechanism]. Generally stated, the foregoing patents disclose relatively complicated devices formed of a plurality of pieces of material which are heat sealed together after toys and the like are inserted therein to form an enclosed, sealed, inflatable device.

Yet another patent of incidental interest in U.S. Pat. No. 1,229,794—Salzer which discloses an illuminated toy balloon and lighting effect which is achieved by inserting a flashlight-shaped object through the inflation aperture and partially into an uninflated balloon.

However, none of the foregoing patents, nor any other prior art of which the present invention is aware, permits the insertion of objects such as flowers, stuffed animals and similar favors into a completely conventional balloon following inflation thereof; none permit the insertion of such objects into a conventional balloon where the object has external dimensions many times greater than the dimensions of the balloon inflation aperture; and, none permit the insertion of objects, such as stuffed teddy bears or the like, which can occupy up to THIRTY PERCENT (30%), or more, of the total volume of space within the inflated balloon. Moreover, the prior art of which the inventor is aware is totally devoid of any suggestion as to either special apparatus and/or methods for simplifying and readily facilitating the easy insertion of objects, including large overstuffed objects, into conventional inflated balloons.

In the foregoing co-pending related application, the present inventor has disclosed, and claimed, the stuffing systems which overcome all of the disadvantages inherent with known conventional systems. However, the specific embodiments of a balloon stuffing system disclosed in the aforesaid co-pending related application do not readily lend themselves to low cost mass production of the type desirable for producing consumer products suitable for use in virtually any home environment.

SUMMARY OF THE INVENTION

The present invention overcomes all of the foregoing disadvantages by providing a simple, compact, rugged, inexpensive balloon stuffing system which requires only a single moving part; yet, which can be readily employed to insert a wide variety of objects—ranging from small buds or flowers, to small gifts, to overstuffed teddy bears and/or similar favors—into completely conventional balloons following inflation thereof, all on a rapid basis employing unskilled personnel who require essentially no training to operate the system. To this end, the balloon stuffing system of the present invention includes a relatively large diameter tubular member which is open at one end and sealed at the other, a manually operable, axially movable, piston-like ejector rod passing through the sealed end of the tubular member, and provision for connecting the interior of the tubular member to a source of air, helium or other suitable inflation medium. Thus, it is merely necessary to: (i) insert the stuffed animal or other favor to be stuffed into the balloon into the inside of the tubular member through the open end thereof; and (ii), stretch the inflation aperture, or mouth, and constricted neck, of an uninflated conventional balloon over, about and around the open end of the tubular member, thus totally sealing the interior thereof. Consequently, upon actuation of the source of inflation medium to pressurize the interior of the tubular member, the balloon is also pressurized, causing the balloon to be inflated to the desired degree. It is then merely necessary to manually shift the axially extending piston-like ejector rod in an axial direction towards the balloon, whereupon the favor disposed within the tubular member is ejected therefrom and projected into the interior of the inflated balloon. The user can then, under most operating conditions, simply twist the balloon several times to form a tight spirally wound neck adjacent the inflation aperture, remove the balloon from the tubular member, and tie off the inflation aperture so as to enclose and seal the favor within the now inflated balloon.

In the simplest form of the present invention, the piston-like ejector rod is preferably hollow, having its free projecting end mounted in an operating handle having an inflation nozzle or mouth piece including a unidirectional valve mechanism formed therein so as to permit the user to inflate the balloon by merely blowing through the nozzle and the tubular ejector rod to pressurize the interior of the tubular member and the balloon mounted on the free open end thereof. Thereafter, it is merely necessary to manually push the piston-like ejector rod so as to eject the object temporarily stowed within the tubular member therefrom and project it into the now inflated balloon which can then be removed from the tubular member and tied off, or sealed, in a conventional way.

In other embodiments of the invention, the projecting portion of the hollow piston-like ejector rod extends into, and forms the piston of, a conventional air inflator or pump which may be of either the single acting or double acting pump variety. In operation, during inflation of the balloon the hollow piston-like ejector rod is latched to, or otherwise restrained from axial motion within, the tubular member while being free to reciprocate within a coaxial pump housing so as to enable air under pressure to be conveyed through the tubular ejector rod and into the interior of the tubular member to pressurize the same and inflate the balloon. When the balloon is fully inflated, the tubular piston-like ejector rod is then latched to the co-axial pump housing while being unlatched from, or otherwise freed for axial motion with, the tubular member containing the object to be stuffed into the balloon so that upon axial closing movement of the pump housing towards the tubular member, the ejector rod is caused to move axially through the tubular member towards the open end thereof, thereby ejecting the object stowed therein and projecting such object into the interior of the balloon.

DESCRIPTION OF THE DRAWINGS

These and other objectives and advantages of the present invention will become more readily apparent upon reading the following Detailed Description and upon reference to the attached drawings, in which.

Figure 1:
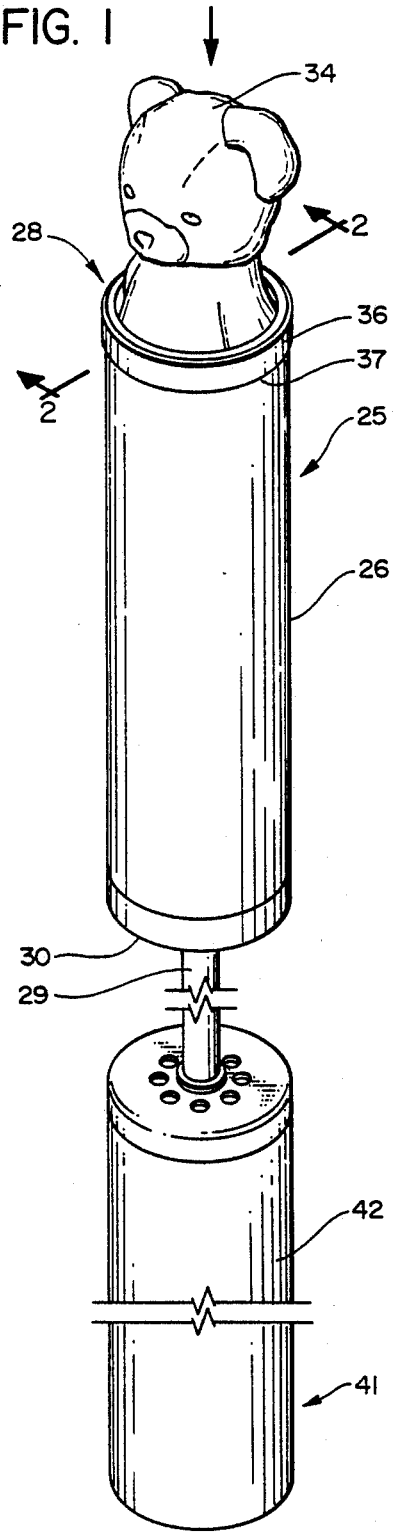
FIG. 1 is a fragmentary isometric view of a balloon stuffing system made in accordance with the present invention and here illustrating the system with an object to be stuffed into the balloon—here a soft teddy bear—inserted part way into the tubular member and wherein the ejector rod for ejecting the teddy bear or other object from the tubular member comprises the piston of a conventional air inflation pump.

While the invention is succeptible of various modifications and alternative forms, specific embodiments thereof have been shown by way of example in the drawings and will herein be described in detail. It should be understood, however, that it is not intended to limit the invention to the particular forms disclosed but, on the contrary, the invention is to cover all modifications, equivalents and/or alternatives falling within the spirit and scope of the invention as expressed in the appended claims.

DETAILED DESCRIPTION

Figure 2:
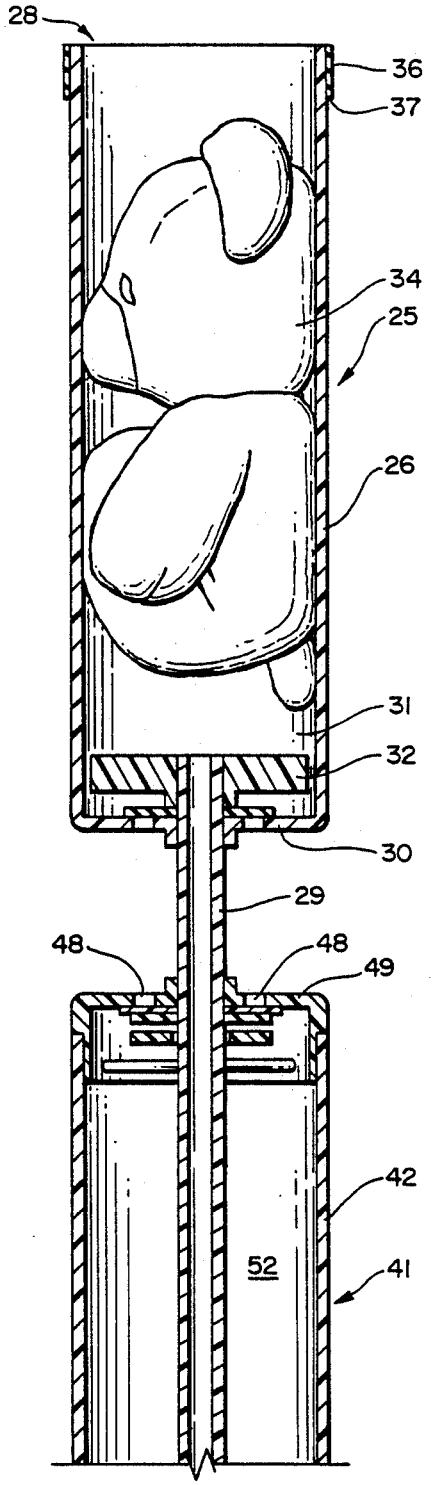
FIG. 2 is a fragmentary vertical sectional view taken substantially along the line 2—2 in FIG. 1, but here illustrating the apparatus with the teddy bear fully inserted into the tubular member.

Turning now to the drawings, and as best illustrated by reference to FIGS. 1 and 2 conjointly, an exemplary balloon stuffer, generally indicated at 25, embodying features of the present invention has been depicted. As here shown, the exemplary balloon stuffer 25 includes an elongate, hollow, tubular member 26 which is open at its upper end, as generally indicated at 28. An elongate ejector rod 29 extends through the opposite end 30 of the tubular member 26 in sealed, slidable relation therewith with the rod 29 extending partially into the chamber 31 defined by the interior of tubular member 26. As best shown by reference to FIG. 2, the exemplary ejector rod 29 includes an ejector support platform 32 mounted on its upper end and translatable within chamber 31. Thus, the arrangement is such that the user may readily insert the object to be stuffed into an inflatable balloon—here, a stuffed teddy bear 34—into the interior chamber 31 defined by the tubular member 26 where the teddy bear or other object is seated on the ejector support platform 32.

Figure 3:
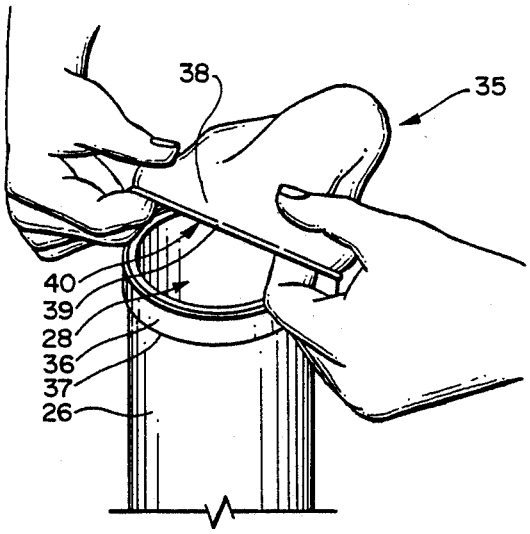
FIG. 3 is a fragmentary isometric view here illustrating the manual stretching of the inflation aperture of a conventional balloon as it is being manually placed over the open end of the balloon stuffer's tubular member.

In carrying out the invention, provision is made for mounting an inflatable balloon, generally indicated at 35 in FIG. 3, over the open end 28 of the tubular member 26 after placement of the teddy bear 34 or other object therein in such a manner that the interior of the balloon 35, together with the chamber 31 in tubular member 26, define an enclosed, totally sealed space with the teddy bear 34 or other favor initially located within the chamber 31. To facilitate such mounting, collar defining means 36 are preferably formed on the uppermost open end 28 of the tubular member 26 in surrounding relation thereto. While such collar defining means 36 may take a wide variety of forms, excellent results have been achieved by adhesively bonding a relatively wide strip of rubber-like material to the tubular member 26 with such material providing a circumferentially disposed, inturned, radial flange 37 at its lower end having a coefficient of friction sufficiently great as to effectively retain the constricted neck portion 38 of balloon 35 in a fixed position about the upper end of tubular member 26 with the balloon's rolled over extremity, or bead, 39 at the inflation aperture, generally indicated at 40 in FIG. 3, being positively seated below the inturned radial flange 37.

In order to inflate the balloon 35, provision is made for coupling chamber 31 of the tubular member 26 to a suitable source of air, helium or other inflation medium. To this end, and in accordance with the embodiment of the invention depicted in FIGS. 1–12, the piston-like ejector rod 29 comprises an elongate, hollow, tubular piston rod associated with any desired conventional air inflator, generally indicated at 41 in FIGS. 1, 2 and 4–6. For example, excellent results have been achieved when using a "QUALATEX" (a registered trademark of Pioneer Balloon Company of Wichita, Kans.) hand air inflator, Item No. 77058, marketed by Pioneer Balloon Company. Thus, and as best illustrated by reference to FIGS. 5 and 6 conjointly, such a commercially available low cost air inflator 41 comprises a hand-held, hand-operated, double acting pump having: (i) a tubular housing 42; (ii) a disk-shaped piston 44 defining an oversized, peripheral, outwardly facing channel 45 for retaining an "O"-ring seal 46 in a selected one of two (2) axial limit positions with the channel 45; (iii) first normally sealed air inlets 48 formed in the uppermost end 49 of housing 42; and (iv), second normally sealed air inlets 50 formed in the lowermost end 51 of housing 42. The arrangement is such that piston 44, together with the "O"-ring seal 46 which is in wiping sealed engagement with the inner sidewall defined by housing 42, define a first upper pressurization chamber 52 in communication with normally sealed air inlets 48 and a second, totally separate, lower pressurization chamber 54 in communication with normally sealed air inlets 50. Piston 44 is provided with one or more radial bores 55 extending from the base of the oversized outwardly facing channel 45 radially inward to a central axial bore 56 which is, in turn, coupled directly to an axially extending through bore 58 formed in the hollow tubular piston-like ejector rod 29 which has its free end fixedly secured to piston 44 in any desired manner.

Figure 4:
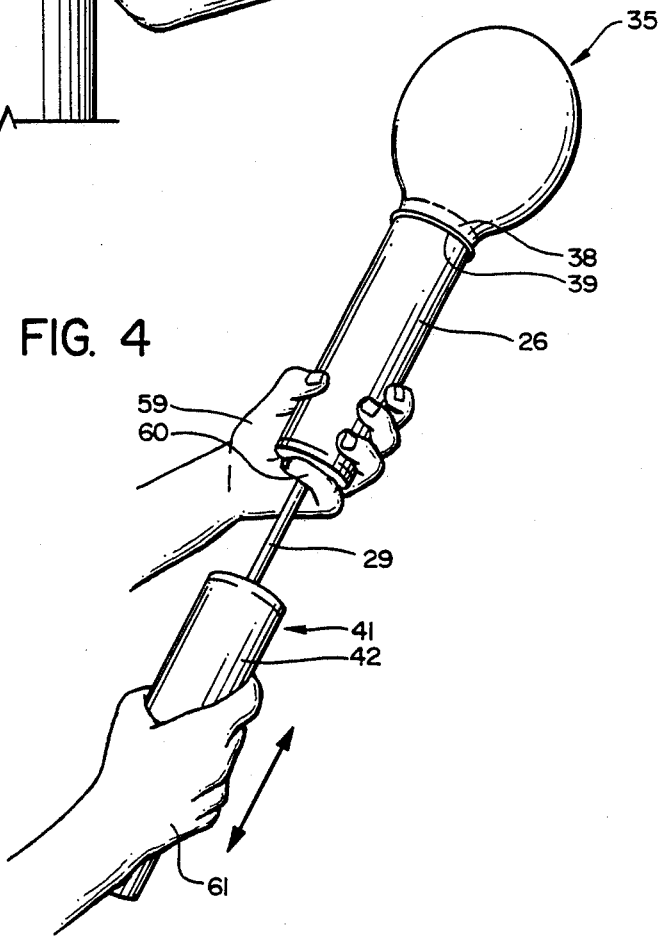
FIG. 4 is a highly diagrammatic isometric view here depicting the manner of inflating a conventional balloon using the embodiment of the invention shown in FIGS. 1 and 2 wherein the piston-like ejector rod is restrained from moving axially within the tubular member during balloon inflation by the user's left hand which grasps not only the tubular member but also the ejector rod.

In operation of the exemplary balloon stuffer 25 shown in FIGS. 1–12, the user preferably grasps tubular member 26 in one hand—e.g., the left hand 59 as viewed in FIG. 4—in such a manner that at least one of the user's fingers 60 is wrapped about the tubular ejector rod 29 so as to lock the ejector rod 29 in a fixed axial position relative to the tubular member 26. Thereafter, the user need merely reciprocate the pump housing 42 using his/her other hand—e.g., the right hand 61 as viewed in FIG. 4—so as to inflate the balloon 35.

Figure 5:
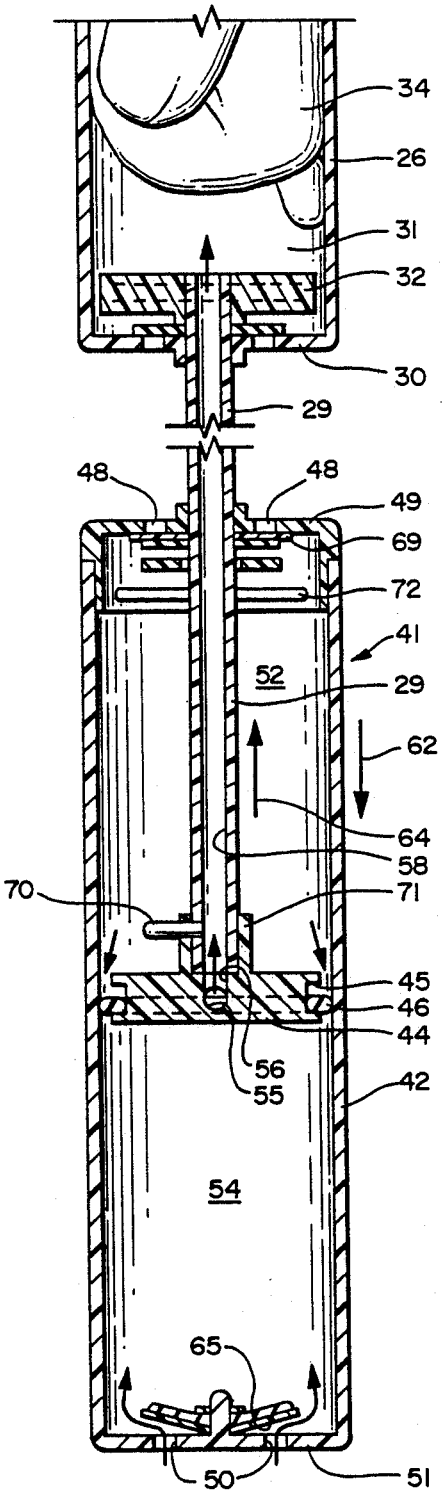
FIG. 5 is a fragmentary vertical sectional view similar to that shown in FIG. 2, but here illustrating the conventional air inflater as comprising a double acting pump wherein air is being conveyed into the tubular member for pressurizing the same and inflating the balloon during that stroke of the pump/piston combination wherein the pump housing is being moved in axial direction away from the coaxial tubular member.

Thus, as best shown in FIG. 5, as the user moves the pump housing 42 through a first stroke in a direction axially away from tubular member 26—i.e., in the direction of the arrow 62—such movement causes sliding movement of the piston seal combination 44/46 towrds the upper end 49 of housing 42—i.e., in the direction of the arrow 64 shown in FIG. 5—thus decreasing the size of pressurization chamber 52 and simultaneously increasing the size of pressurization chamber 54. As a consequence, a partial vacuum is created in chamber 54 which serves to permit a flexible disk-like sealing element 65 which normally closes air inlets 50 to flex inwardly, thus opening air inlets 50 and allowing air to enter chamber 54. At the same time, as the piston seal combination 44/46 wipes along the inner surface of housing 42, the frictional forces generated between the "O"-ring seal 46 and the housing 42 serve to shift the seal 46 axially into a first limit position defined by the lower half of oversized channel 45, thereby placing radial bore 55 in direct communication with pressure chamber 52. Consequently, as the user continues to move pump housing 42 away from tubular member 26, air contained within chamber 52, whose size is being reduced, is forced htorugh radial bore 55, axial bore 56, and then through axial bore 58 formed in ejector rod 29, thereby pressurizing chamber 31 within tubular member 26 and, therefore, the interior of balloon 35 (FIG. 4) causing partial inflation of the latter.

Figure 6:
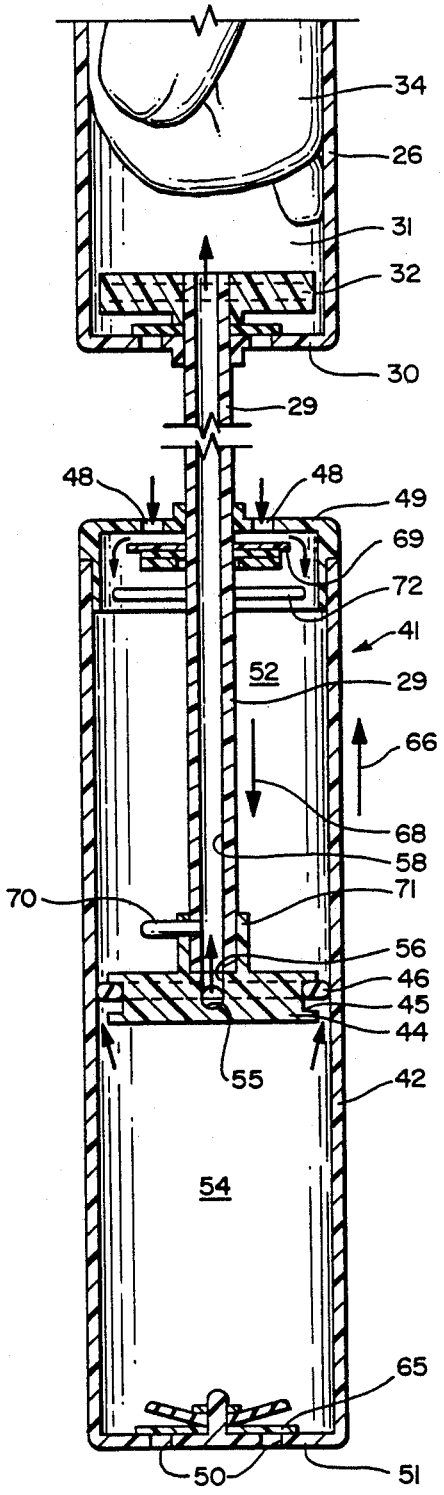
FIG. 6 is a fragmentary vertical sectional view similar to FIG. 5, but here illustrating pressurization of the interior of the tubular member during the opposite stroke of the pump/piston combination when the pump housing is being moved coaxially towards the tubular member.

Upon completion of the operating stroke of the pump 41 as described above in connection with FIG.5, the user need merely move the pump housing 42 in the opposite direction—i.e., in the direction of the arrow 66 shown in FIG. 6, or towards tubular member 26—thus causing the ejector rod 29 to move relative to the pump housing 42 in the direction of arrow 68, decreasing the size of pressurization chamber 54 while simultaneously increasing the size of pressurization chamber 52. The partial vacuum thus created in pressurization chamber 52 serves to permit axial movement of a disk-like sealing element 69 which normally seals air inlets 48, opening the inlets so as to allow air to enter chamber 52. At the same time, the frictional engagement between "O"-ring seal 46 and housing 42 causes the seal 46 to move to a second limit axial position wherein it is disposed in the upper half of the oversized channel 45 in piston 44. This serves to seal radial bore 55 from pressure chamber 52 while simultaneously coupling radial bore 55 to pressure chamber 54. Thus, as the operating stroke is continued, air within pressurization chamber 54 is conveyed through radial bore 55, axial bore 56 and then through axial bore 58 in ejector rod 29 so as to continue to pressurize chamber 31 in tubular member 26 and thereby the interior of balloon 35 (FIG. 4), further inflating the latter.

Figure 7:
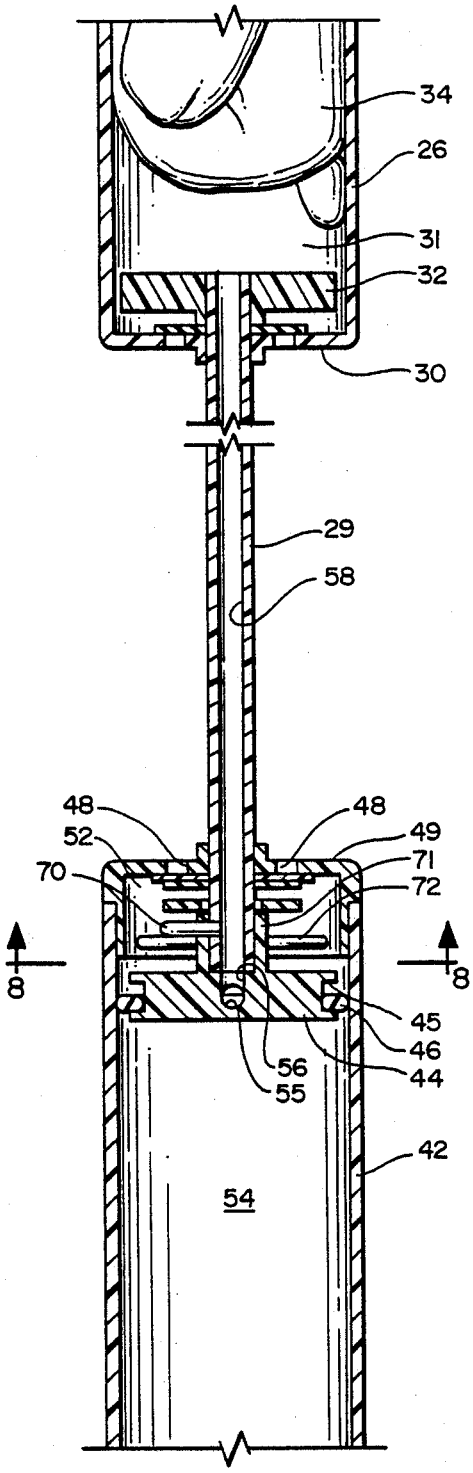
FIG. 7 is a fragmentary vertical sectional view here illustrating one modified form of conventional pump construction enabling the pump's piston, which also serves the dual function of an ejector rod for the tubular member, to be locked to the pump housing preparatory to ejecting the teddy bear or other object from the tubular member into the interior of the now inflated balloon.
Figure 8:
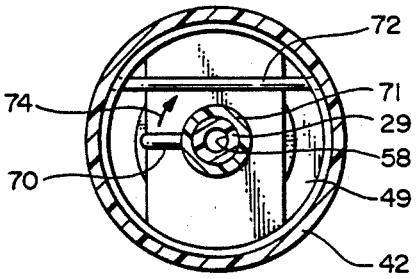
FIG. 8 is a horizontal or transverse sectional view taken substantially along the line 8—8 in FIG. 7 and here illustrating the relative position of the components of the pump prior to latching the piston to the pump housing.
Figure 9:
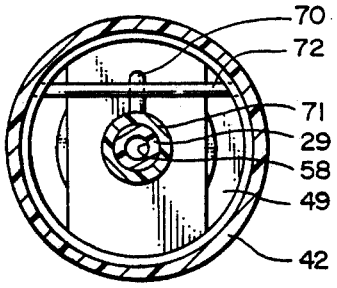
FIG. 9 is a horizontal sectional view similar to FIG. 8, but here illustrating the components of the pump after latching of the piston rod to the pump housing.

Once the user has inflated the balloon 35 (FIG. 4) by the desired amount, provision is made for latching the piston-like ejector rod 29 to the pump housing 42 so as to prevent further relative axial movement therebetween. To accomplish this, the otherwise conventional air inflator 41 has been modified by providng an internal, radially projecting, locking pin 70 mounted on the hub 71 of piston 44, with such locking pin 70 projecting laterally from the hub into the upper pressurization chamber 52. Additionally, a rod-like latching detent 72, best illustrated in FIGS. 7–9, has its opposite ends fixedly mounted in pump housing 42 with the latching detent 72 lying on a chord spaced slightly below, and parallel to, the uppermost end 49 of pump housing 42, Thus, the arrangement is such that when the balloon 35 (FIG. 4) is inflated to the desired degree, and when the piston 44 is at the uppermost position within pump housing 42 as best shown in FIG. 7, the laterally projecting, radial locking pin 70 lies in a horizontal plane just above the horizontal plane containing the latching detent 72. In this condition, it is merely necessary for the user to rotate the pump housing 42 relative to the ejector rod 29—e.g., in a clockwise direction as indicated by the arrow 74 in FIG. 8—so as to shift the locking pin 70 to a position overlying latching detent 72 as best shown in FIG. 9, thereby precluding relative axial movement between the pump housing 42 and the ejector rod 29.

Figure 10:
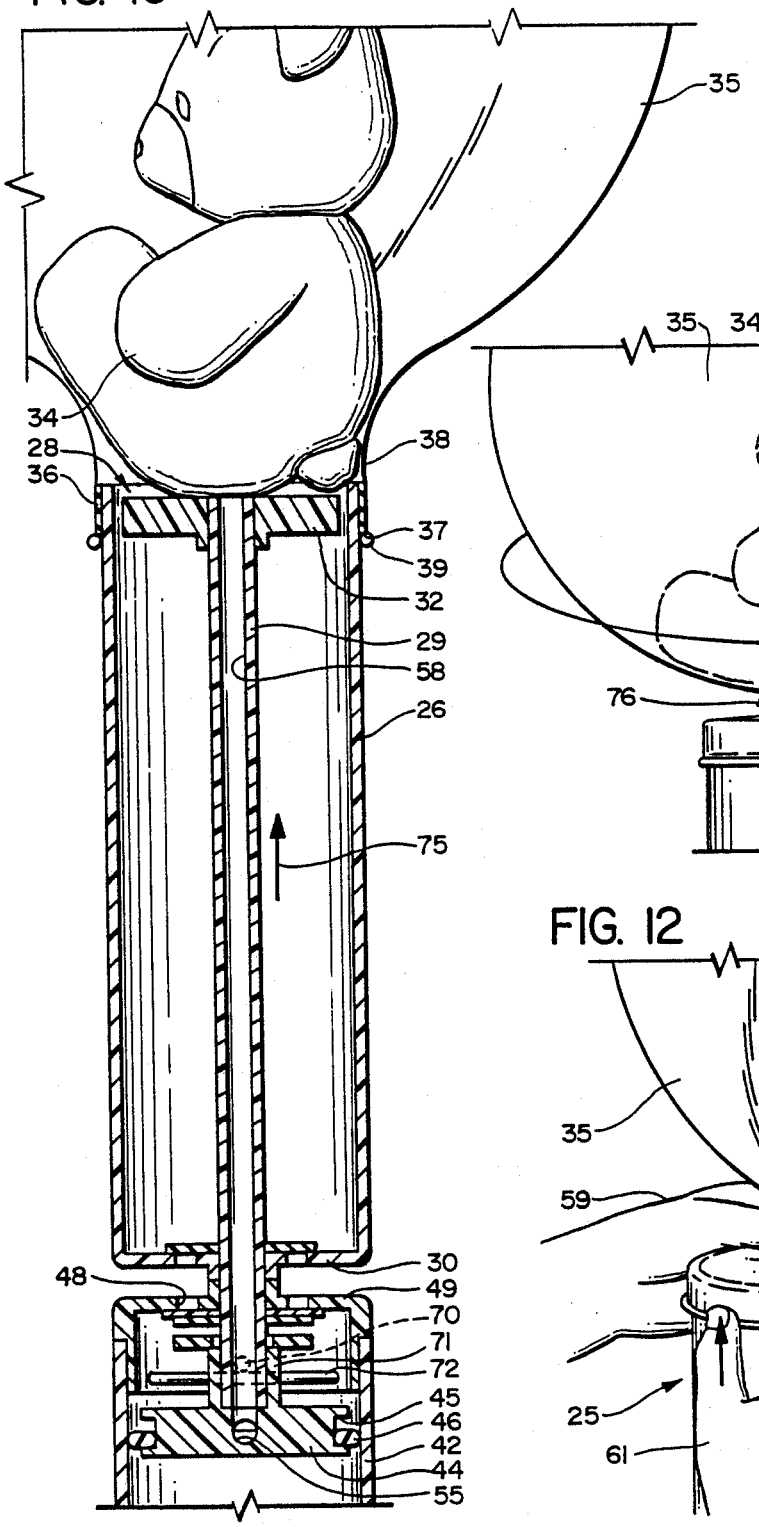
FIG. 10 is a fragmentary, vertical, sectional view illustrating the manner of ejecting the teddy bear or other object from the tubular member into the now inflated balloon.
Figure 11:
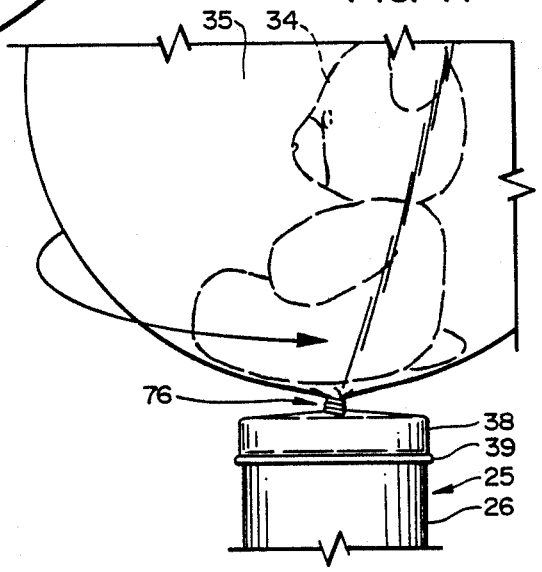
FIG. 11 is a fragmentary side elevational view here illustrating the manner of twisting the stuffed balloon prior to removal from the tubular member of the balloon stuffer so as to form a tightly wound spiral in the constricted neck portion of the balloon adjacent the inflation aperture so as to effect a temporary seal for the balloon.

At this point in the operating cycle, the user is ready to eject the teddy bear 34 (or other object or favor) from chamber 31 in tubular member 26 and to project such object into the interior of the now inflated balloon 35. To accomplish this, and as best illustrated in FIG. 10, the user need merely release the grasp he/she has maintained on the ejector rod 29 (e.g., with the user's left finger 60 as shown in FIG. 4) and move the pump housing 42 axially towards tubular member 26. Since the ejector rod 29 is now latched to the pump housing 42 in the manner described above in connection with FIGS. 7–9, such relative closing axial movement between the pump housing 42 and the tubular member 26 causes the ejector rod 29 and the ejector support platform 32 mounted thereon to move axially through tubular member 26 (in the direction of arrow 75 in FIG. 10)

towards the open end 28 thereof about which the now inflated balloon 35 is mounted, thus ejecting the teddy bear 34 from chamber 31 and stuffing the teddy bear into the inflated balloon 35. At this point, the user need only turn the balloon 35 several times relative to the balloon stuffer 35 so as to tightly wind the constricted neck portion 38 of the balloon 35 in a tight spiral or helical configuration, generally indicated at 76 in FIG. 11, thereby effecting a temporary seal for the balloon.

Figure 12:
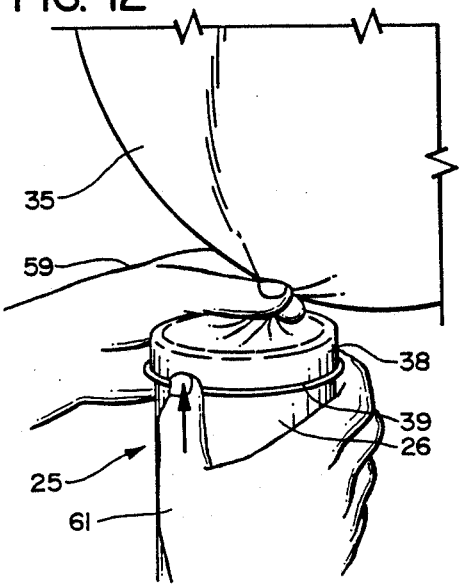
FIG. 12 is a fragmentary isometric view here illustrating how the user manually removes the now stuffed, inflated balloon from the balloon stuffer prior to tying the balloon off.

As best shown in FIG. 12, the user can then simply grasp the spirally wound constricted neck portion 38 of the inflated stuffed balloon 35—for example, between the thumb and forefinger of one hand 59—while using the other hand 61 to shift the rolled bead 39 adjacent the inflation aperture 40 of the balloon upwardly over the collar defining means 36 (FIG. 3) so as to remove the inflated stuffed balloon 35 from the balloon stuffer 25. The constricted neck portion 38 of the balloon 35 can now be knotted in a conventional fashion (not shown) or otherwise tied off so as to permanently seal the inflated balloon 35 with the teddy bear 34 or other favor stuffed inside.

Figure 13:
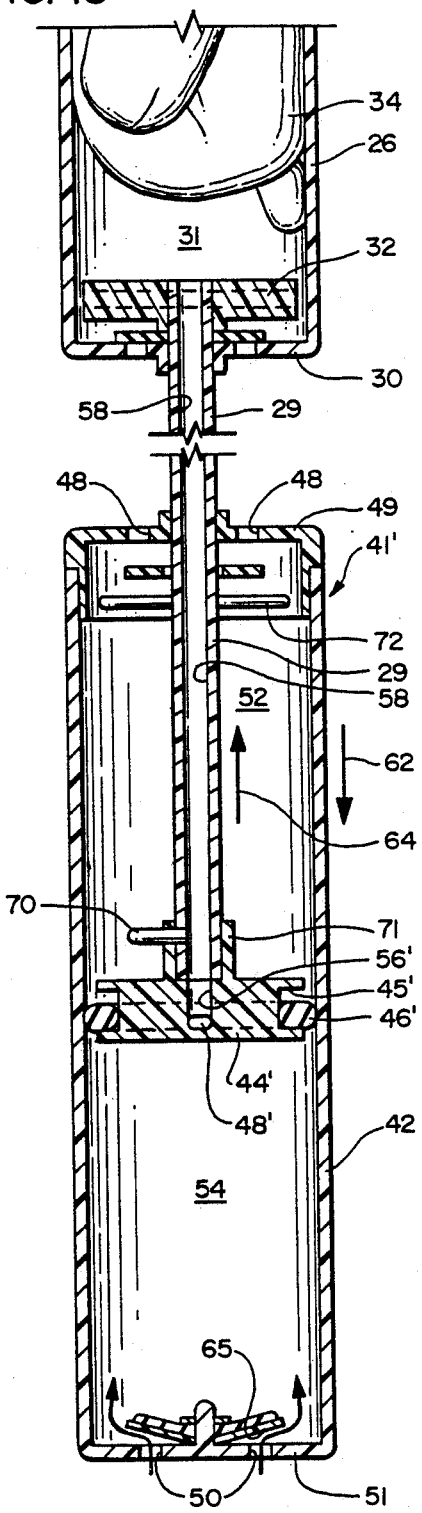
FIG. 13 is a fragmentary vertical sectional view similar to FIG. 5, but here illustrating a slightly modified form of the invention wheren the conventional air inflater takes the form of a single acting pump with the apparatus here being shown during that portion of the operating cycle of the pump when the pump housing is being moved coaxially away from the tubular member so as to permit the intake of air into the lowermost chamber of the pump.
Figure 14:
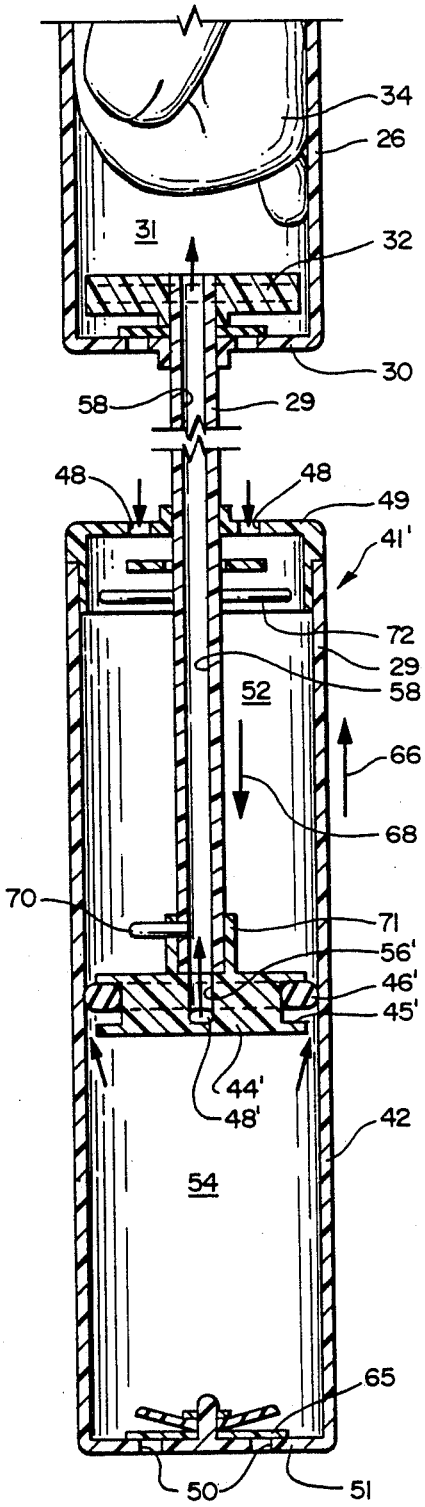
FIG. 14 is a fragmentary vertical sectional view similar to FIG. 13, but here illustrating that portion of the operating pump cycle when the pump housing is being moved coaxially towards the tubular member so as to pressurize the interior of the tubular member and any balloon mounted on the free open end thereof.

Turning now to FIGS. 13 and 14, a slightly modified embodiment of the invention has been illustrated which, in this instance, employs a conventional single acting air inflator or pump, generally indicated at 41'. Because of the similarities in construction and mode of operation between the single acting air pump 41' of FIGS. 13 and 14 and the double acting air pump 41 of FIGS. 5 and 6, like reference numbers will be used to designate identical parts while those parts which have been modified will employ the same reference number with a prime superscript.

Thus, as here shown, the modified single acting air pump 41' includes the same basic components as the double acting pump 41 previously described except that the uppermost disk-like seal 69 (FIGS. 5 and 6) which normally seals air inlets 48 has been eliminated—i.e., the air inlets 48 are always open and, therefore, the chamber 52 does not serve as a pressurization chamber—and, additionally, the relative dimensions of the piston 44', channel 45', "O"-ring seal 46' and bores 48', 56' have been altered. As a consequence, during movement of the pump housing 42 in an axial direction away from tubular member 26—i.e., in the direction of the arrow 62 shown in FIG. 13—the piston 44' moves axially towards the upper end 49 of housing 42, thus reducing the size of chamber 52 while increasing the size of pressurization chamber 54. However, because of the relative dimensional changes in the sizes of the channel 45' in piston 44', the seal 46', and the radial bore 48', during this cycle of operation the "O"-ring seal 46' serves to totally overly and seal bore 48'; and, consequently, air is incapable of being moved from chamber 52 into chamber 31 in tubular member 26. And, of course, loss of air from chamber 31 through the aligned bores 58, 56', and 48' is also prevent by seal 46'. As the size of chamber 52 is reduced, the air contained therein moves outwardly through the uppermost air inlets 48 while air enters chamber 54 through air inlets 50 in the same manner as previously described.

However, during movement of the pump housing 42 in the opposite direction—viz., towards tubular member 26 as indicated by the arrow 66 in FIG. 14—piston 44' moves axially downward relative to housing 42 as indicated by arrow 68, thereby increasing the size of chamber 52 and decreasing the size of pressurization chamber 54. In this instance, the frictional forces generated by wiping engagement of the "O"-ring seal 46' and the housing 42 serve to shift the seal 46' axially to its uppermost limit position within channel 45', thus placing radial bore 48' in fluid communication with pressurization chamber 54 and permitting pressurization of chamber 31 in tubular member 26 in the manner previously described. During this operation, as the size of chamber 52 is increased, air moves back into chamber 52 through the air inlets 48.

Thus, those persons skilled in the art will appreciate that the present invention finds equally advantageous application when used with conventional air pumps 41 of the double acting type as shown in FIGS. 5 and 6 or, alternatively, with single acting pumps of the type shown at 41' in FIGS. 13 and 14.

Figure 15:
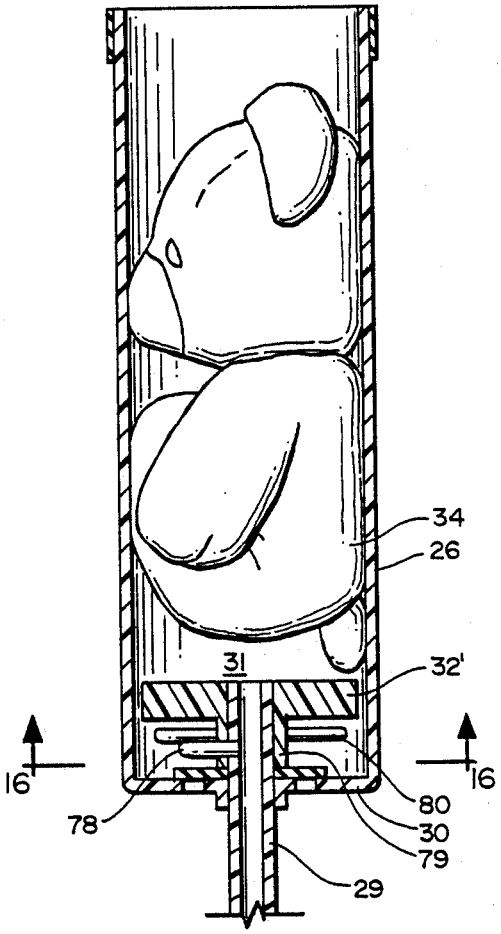
FIG. 15 is a fragmentary vertical sectional view illustrating a slightly modified construction for the tubular member permitting selective physical latching and/or unlatching of the ejector rod with respect to the tubular member.
Figure 16:
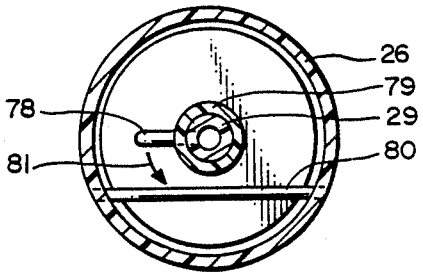
FIG. 16 is a horizontal sectional view taken substantially along the line 16—16 in FIG. 15, here illustrating details of the exemplary latching mechanism with the tubular member and ejector rod being shown in the unlatched state.
Figure 17:
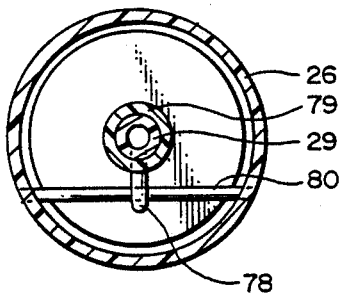
FIG. 17 is a horizontal sectional view similar to FIG. 16, but here illustrating the tubular latching member and ejector rod in the latched state.

Turning next to FIGS. 15–17, yet another modified form of the invention has been illustrated wherein, provision is made for mechanically latching and/or unlatching the ejector rod 29 to and from the tubular member 26 as constrasted with achieving such effect by manually grasping both the tubular member 26 and the ejector rod 29 in the manner shown in FIG. 4. In this instance, a locking pin 78 is mounted in the hub 79 of an ejector support platform 32' mounted on ejector rod 29 with the locking pin 78 projecting laterally and radially outward from hub 79. Additionally, a rod-like latching detent 80 is mounted within tubular member 26 with such detent lying on a chord in a horizontal plane spaced slightly above both the locking pin 78 and the closed sealed end 30 of tubular member 26. In operation, the user need merely rotate either tubular member 26 or ejector rod 29—for example, in the direction indicated by the arrow 81 in FIG. 16—prior to commencing a balloon inflation operating cycle so as to shift the locking pin 78 into a position underlying the latching detent 80, at which point the component parts will be in the positions shown in FIG. 17, thereby effectively precluding relative axial movement between ejector rod 29 and tubular member 26 without having to manually grasp both the tubular member 26 and the ejector rod 29 as shown in FIG. 4.

When the balloon 35 (FIG. 4) is fully inflated and the user is ready to stuff the teddy bear 34 or other object contained within chamber 31 into the balloon 35, the user need only again rotate either the ejector rod 29 or the tubular member 26 so as to return the component parts to their relative positions as shown in FIG. 16. Consequently, when the ejector rod 29 is latched to the pump housing (not shown in FIGS. 15–17) in the manner previously described, the user can freely eject the teddy bear 34 or other object from chamber 31 by simply shifting the latched pump housing 42 and ejector rod 29 towards tubular member 26.

While not illustrated in the drawings, those skilled in the art will readily appreciate that numerous other arrangements can be provided for selectively latching and/or unlatching the tubular member 26 to and from the ejector rod 29 such, merely by way of example, as a spring biased detent (not shown) which can be mounted on tubular member 26 in sealed relation therewith and which can be manually depressed by the user during an inflation cycle to lock the support platform 32' (32) in place.

Figure 18:
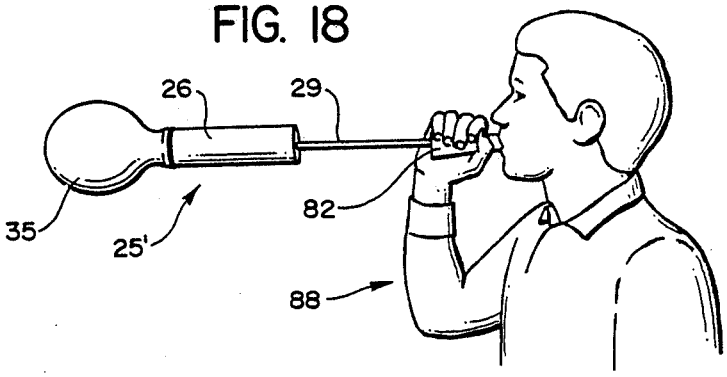
FIG. 18 is a highly diagrammatic isometric view here depicting a slightly modified form of the invention wherein no separate pump is required; but, rather, the user inflates the balloon prior to stuffing thereof by blowing through the tubular piston-like ejector rod.
Figure 19:
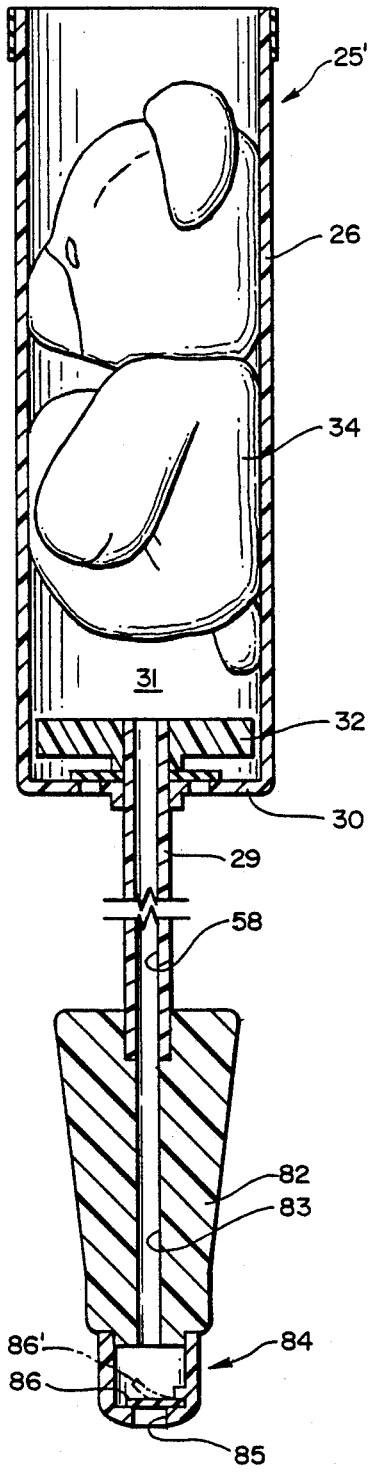
FIG. 19 is a fragmentary vertical sectional view similar to that shown in FIGS. 2, 5, 6, 13 and 14, but here illustrating details of the embodiment of the invention shown in FIG. 18; and, FIG. 20 is a fragmentary vertical sectional view here depicting the embodiment of the invention of FIGS. 18 and 19 and illustrating the relative position of the tubular piston-like ejector rod and the tubular member as the teddy bear or other object is ejected from the tubular member and stuffed into the inflated balloon.
Figure 20:
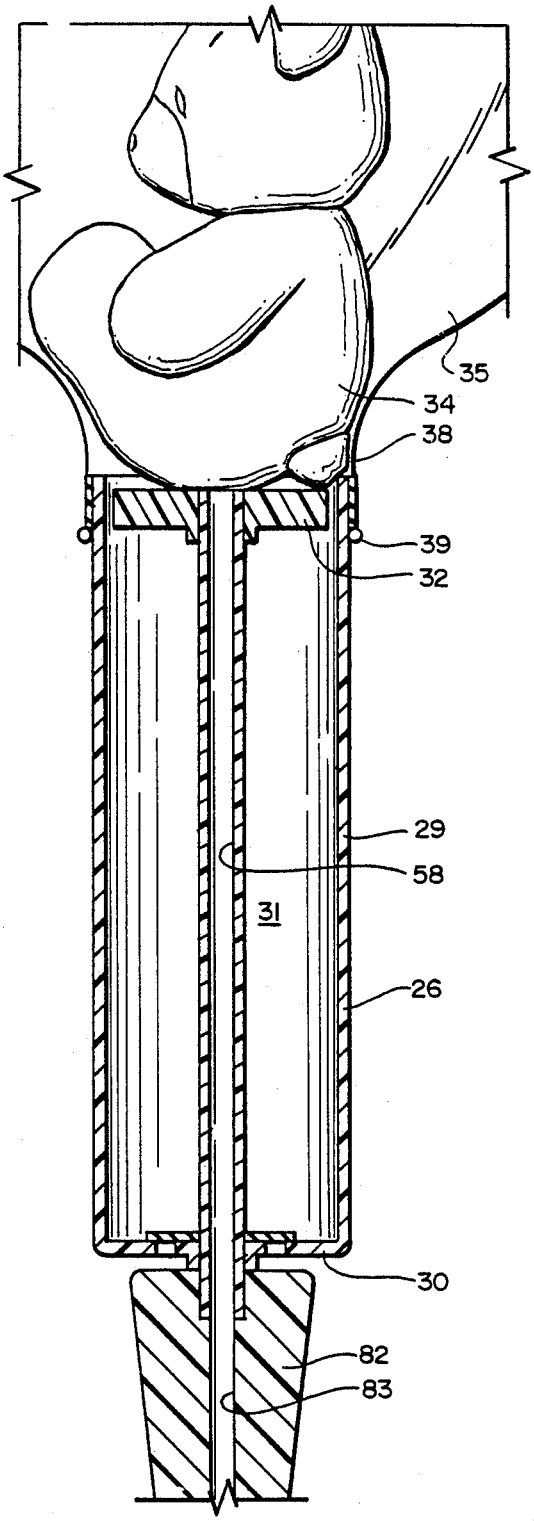

A still further modified form of the invention has been illustrated in FIGS. 18–20 which eliminates the need for use of a separate air inflation pump of the type shown at 41 and 41' in respective ones of FIGS. 5 and 13. Thus, as here shown, a modified balloon stuffer 25' has been depicted which employs a tubular member 26, ejector rod 29, and ejector support platform 32 which are constructed and operate in the same manner as previously described in connection with the balloon stuffer 25 of FIG. 2. However, in this instance, rather than coupling the tubular ejector rod 29 to a separate pump, the lower projecting end of the rod 29 is mounted in a somewhat frusto-conical handle 82 having a through axial bore 83 coupled with bore 58 in ejector rod 29. The apicad end of handle 82 terminates in a mouthpiece assembly, generally indicated at 84, having an inflation inlet 85 which is normally closed by a flexible flat sealing element 86. The arrangement is such that when the user, generally indicated at 88 in FIG. 18, wishes to inflate a balloon 35, he/she need merely place the mouthpiece assembly 84 in his/her mouth in the manner shown in FIG. 18. The user 88 then exhales through the inflation inlet 85, thereby deflecting the flexible sealing element 86 into the broken line position shown in FIG. 19 at 86'. When the user 88 ceases blowing through the inflation inlet 85 in order to draw another breath, the increased pressure within chamber 31 serves to restore the flexible sealing element 86 to its solid line position shown in FIG. 19, thereby preventing escapage of air from chamber 31 (FIG. 19) and from the partially inflated balloon 35 (FIG. 18). When the balloon 35 is fully inflated, the user need only grasp the handle 82 in one hand and the tubular member 26 in the other, shifting the handle towards the tubular member so as to eject the teddy bear 34 or other object from the chamber 31 and stuff it into the balloon 35 as shown in FIG. 20.

Thus, those persons skilled in the art will appreciate that there have herein been illustrated and described highly effective, yet simple, balloon stuffing systems which require only a few components of conventional construction and which are capable of being assembled on a mass production basis at low cost using relatively unskilled workers. Yet, the balloon stuffing systems are highly effective and may be readily employed by unskilled personnel, including children, to stuff relatively large objects into conventional balloons.

What is claimed is:

1. The method of inflating and stuffing an inflatable balloon of the type having an inlet aperture and a constricted neck portion comprising the steps of:

(a) inserting the object to be stuffed into a tubular member having a first open end and a second closed sealed end and having a hollow, tubular, piston-like ejector rod passing through, and having an end portion projecting beyond, the second closed sealed end thereof and being axially slidable therein;

(b) attaching an uninflated balloon to the first open end of the tubular member with the constricted neck portion thereof surrounding and in sealed engagement with the tubular member;

(c) coupling the projecting end portion of the hollow, tubular, piston-like ejector rod to a source of fluid under pressure so as to pressurize the interior of both the tubular member and the balloon and thereby inflate the latter;

(d) shifting the hollow, tubular, piston-like ejector rod axially towards the first open end of the tubular member so as to eject the object contained therein and project such object into the interior of the inflated balloon;

(e) removing the inflated stuffed balloon from the tubular member; and (f) knotting or otherwise tying off the constricted neck portion of the balloon so as to seal the balloon with the object retained captive therein.

2. The method as set forth in claim 1 wherein the projecting end portion of the hollow, tubular, piston-like ejector rod terminates in a mouthpiece having a unidirectional valve and wherein the interiors of the tubular member and the balloon are pressurized to inflate the balloon by blowing through the mouthpiece and the ejector rod is shifted axially to eject the object temporarily stored in the tubular member and to stuff such object into the inflated balloon by manually grasping the projecting end portion of the ejector rod and shifting it axially towards the tubular member.

3. The method as set forth in claim 1 wherein the projecting end portion of the hollow, tubular, piston-like ejector rod comprises the piston rod of a hand-held, hand-operated air inflation pump having a pump housing and a pistion coupled to the ejector rod and axially translatable within the pump housing.

4. The method as set forth in claim 3 wherein the tubular member and the projecting end portion of the hollow, tubular, piston-like ejector rod are grasped to prevent relative axial movement therebetween during manual operation of the air inflation pump.

5. The method as set forth in claim 3 wherein: (i) the hollow, tubular, piston-like ejector rod is precluded from relative axial movement with respect to the tubular member and free to move axially relative to the pump housing during operation of the pump; and (ii), the hollow, tubular, piston-like ejector rod is released and freed for relative axial movement with respect to the tubular member and latched to the pump housing during ejection of the object from the tubular member and insertion thereof into the balloon.

6. The method as set forth in claim 3 wherein the pump is a double acting pump.

7. The method as set forth in claim 3 wherein the pump is a single acting pump.

8. A balloon stuffer for use in stuffing toys, stuffed animals, gifts, flowers and similar objects into the interior of conventional inflated balloons of the type having an inflation aperture and a constricted neck portion, said balloon stuffer comprising, in combination;

(a) a tubular member having:

(i) a first open end adapted to receive the object to be stuffed into a balloon and to temporarily store such object entirely within said tubular member;

(ii) a second closed sealed end; and, (iii) a fluid impervious sidewall;

(b) an injector mechanism postioned within said tubular member, said ejector mechanism having a hollow, tubular, piston-like ejector rod extending outwardly through, and having an end portion projecting beyond, said second closed sealed end of said tubular member with freedom for axial movement through said second closed sealed end;

(c) means for coupling said projecting end portion of said hollow, tubular, piston-like ejector rod to a source of inflation fluid; and, (d) means for axially shifting said ejector mechanism towards said first open end of said tubular member so as to engage the object temporarily stored in said tubular member and eject such object from said tubular member;

whereby stretching and seating of the inflation aperture and constricted neck portion of a conventional, uninflated, inflatable balloon over and about said first open end of said tubular member serves to create a totally enclosed sealed chamber comprising the interior of said tubular member and the interior of the balloon, and coupling of said projecting end portion of said hollow, tubular, piston-like ejector rod to a source of fluid under pressure serves to pressurize the totally enclosed sealed chamber and to inflate the balloon so that upon axial shifting of said ejector mechanism, the object contained within said tubular member is engaged thereby, ejected therefrom, and inserted into the interior of the inflated balloon, whereupon the inflated balloon and the object stored therein may be removed from said tubular member and the constricted neck portion of the inflated balloon knotted or otherwise tied off so as to seal the balloon in the inflated state with the object stored therein.

9. A balloon stuffer as set forth in claim 8 wherein said means for coupling said projecting end portion of said hollow, tubular, piston-like ejector rod to a source of inflation fluid comprises a mouthpiece mounted on the free end of said projecting end portion of said ejector rod and having: (i) an axial bore communicating with said hollow, tubular, piston-like ejector rod; and (ii), means defining a unidirectional valve for permitting passage of air under pressure through said mouthpiece and said ejector rod and into said tubular member and the balloon mounted on the open end thereof; whereby the balloon can be inflated by blowing into the mouthpiece.

10. A balloon stuffer as set forth in claim 8 wherein the source of inflation medium comprises a hand-held, hand-operated inflation pump having a pump housing and a reciprocable piston mounted therein, said piston dividing said housing into first and second air chambers and including a radial bore adapted to be coupled in fluid transmitting relation to one of said first and second air chambers during axial reciprocation of said piston within said housing in a first direction toward said one chamber; and, said means for coupling said projecting end portion of said hollow, tubular, piston-like ejector rod to said source of inflation medium comprises a fitting for connecting said hollow, tubular, piston-like ejector rod to said piston in fluid transmitting relation with said radial bore whereby during axial reciprocation of said piston within said pump housing in said first direction toward said one chamber, air contained within said one chamber is displaced therefrom through said radial bore and said hollow, tubular, piston-like ejector rod into said tubular member and the balloon mounted on said open end thereof so as to inflate the balloon.

11. A balloon stuffer as set forth in claim 10 wherein said pump is a single acting pump.

12. A balloon stuffer as set forth in claim 10 wherein said pump is a double acting pump and said radial bore in said piston is adapted to be coupled in fluid transmitting relation: (i) to one of said first and second air chambers during axial reciprocation of said piston within said housing in a first direction toward said one chamber; and (ii), to the other of said first and second air chambers during axial reciprocation of said piston within said housing in the opposite direction toward the other of said first and second air chambers, whereby the interior of said tubular member and the balloon mounted on said open end thereof are alternately pressurized by air transmitted thereto from said first and second air chambers during alternate reciprocating axial strokes of said piston within said pump housing.

13. A balloon stuffer as set forth in claim 10 wherein means are provided for selectively latching and unlatching said piston to and from said pump housing so as to permit unlatching thereof during an operating cycle of said pump while the balloon is being inflated and latching thereof following inflation of the balloon whereby when said piston is latched to said pump housing and said pump housing is moved axially toward said tubular member said ejector rod serves to engage the object temporarily stored in said tubular member and to eject the object therefrom and insert the object into the inflated balloon mounted on said open end thereof.

14. A balloon stuffer as set forth in claim 13 wherein means are provided for selectively latching and unlatching said ejector rod to and from said tubular member when said ejector rod is respectively unlatched from said latched to said pump housing.

15. A balloon stuffer as set forth in claim 11 wherein means are provided for selectively latching and unlatching said piston to and from said pump housing so as to permit unlatching thereof during an operating cycle of said pump while the balloon is being inflated and latching thereof following inflation of the balloon whereby when said piston is latched to said pump housing and said pump housing is moved axially toward said tubular member said ejector rod serves to engage the object temporarily stored in said tubular member and to eject the object therefrom and insert the object into the inflated balloon mounted on said open end thereof.

16. A balloon stuffer as set forth in claim 15 wherein means are provided for selectively latching and unlatching said ejector rod to and from said tubular member when said ejector rod is respectively unlatched from and latched to said pump housing.

17. A balloon stuffer as set forth in claim 12 wherein means are provided for selectively latching and unlatching said piston to and from said pump housing so as to permit unlatching thereof during an operating cycle of said pump while the balloon is being inflated and latching thereof following inflation of the balloon whereby when said piston is latched to said pump housing and said pump housing is moved axially toward said tubular member said ejector rod serves to engage the object temporarily stored in said tubular member and to eject the object therefrom and insert the object into the inflated balloon mounted on said open end thereof.

18. A balloon stuffer as set forth in claim 17 wherein means are provided for selectively latching and unlatching said ejector rod to and from said tubular member when said ejector rod is respectively unlatched from and latched to said pump housing.

* * * * *